US010167737B2

(12) United States Patent
Reinhardt et al.

(10) Patent No.: US 10,167,737 B2
(45) Date of Patent: Jan. 1, 2019

(54) STRUCTURAL GUIDE VANE CIRCUMFERENTIAL LOAD BEARING SHEAR PIN

(71) Applicant: United Technologies Corporation, Hartford, CT (US)

(72) Inventors: Gregory E. Reinhardt, South Glastonbury, CT (US); Paul Thomas Rembish, East Hampton, CT (US); Steven L. Conner, Avon, CT (US); Thomas B. Hyatt, Cromwell, CT (US); Steven J. Feigleson, Falmouth, ME (US); Carl Brian Klinetob, East Haddam, CT (US)

(73) Assignee: United Technologies Corporation, Farmington, CT (US)

( * ) Notice: Subject to any disclaimer, the term of this patent is extended or adjusted under 35 U.S.C. 154(b) by 531 days.

(21) Appl. No.: 14/433,861

(22) PCT Filed: Mar. 12, 2013

(86) PCT No.: PCT/US2013/030318

§ 371 (c)(1),
(2) Date: Apr. 7, 2015

(87) PCT Pub. No.: WO2014/062220

PCT Pub. Date: Apr. 24, 2014

(65) Prior Publication Data

US 2015/0275694 A1 Oct. 1, 2015

Related U.S. Application Data

(60) Provisional application No. 61/714,814, filed on Oct. 17, 2012.

(51) Int. Cl.
*F01D 25/26* (2006.01)
*F01D 9/02* (2006.01)
*F01D 25/16* (2006.01)

(52) U.S. Cl.
CPC ..... *F01D 25/26* (2013.01); *F01D 9/02* (2013.01); *F01D 25/162* (2013.01);
(Continued)

(58) Field of Classification Search
CPC ..... F01D 9/02; F01D 9/042; F01D 25/162; F01D 25/24; F01D 25/243; F01D 25/246;
(Continued)

(56) References Cited

U.S. PATENT DOCUMENTS 2,919,890 A * 1/1960 Smith ..... F01D 17/162 415/135
3,395,857 A * 8/1968 Petrie ..... F01D 21/045 384/114

(Continued)

OTHER PUBLICATIONS

Extended European Search Report for EP Application No. 13847588.4 dated Jun. 30, 2016.

(Continued)

*Primary Examiner* — Richard Edgar
*Assistant Examiner* — Alexander White
(74) *Attorney, Agent, or Firm* — Carlson, Gaskey & Olds, P.C.

(57) ABSTRACT

A turbofan engine structural guide vane is mounted to a forward bulkhead of a core engine case structure at an inner end and to a fan case at an outer end. A plurality of shear pins extend from the aft portion of the structural guide vane into a corresponding plurality of openings defined in the bulkhead for bearing circumferential loads.

12 Claims, 3 Drawing Sheets

(52) U.S. Cl.
CPC ..... *F05D 2220/36* (2013.01); *F05D 2230/64* (2013.01); *F05D 2230/642* (2013.01); *F05D 2230/644* (2013.01); *F05D 2260/311* (2013.01); *F05D 2260/36* (2013.01); *F05D 2260/39* (2013.01); *Y10T 29/49323* (2015.01)

(58) Field of Classification Search
CPC ..... F01D 25/26; F01D 25/28; F05D 2220/36; F05D 2230/64; F05D 2230/642; F05D 2230/644; F05D 2240/12; F05D 2240/14; F05D 2260/30; F05D 2260/31; F05D 2260/311; F05D 2260/36; F05D 2260/37; F05D 2260/39
See application file for complete search history.

(56) References Cited

U.S. PATENT DOCUMENTS

| | | | | |
|---|---|---|---|---|
| 4,632,634 | A | 12/1986 | Vinciquerra et al. | |
| 6,843,638 | B2 | 1/2005 | Hidalgo | |
| 7,018,173 | B2 | 3/2006 | Bongrand et al. | |
| 7,144,218 | B2 | 12/2006 | Dube et al. | |
| 7,730,715 | B2 * | 6/2010 | Grudnoski | F01D 25/162 415/209.3 |
| 2007/0264128 | A1 | 11/2007 | Grudnoski et al. | |
| 2008/0159851 | A1 | 7/2008 | Moniz et al. | |
| 2009/0208338 | A1 | 8/2009 | Major et al. | |
| 2010/0247306 | A1 | 9/2010 | Merry et al. | |
| 2010/0290904 | A1 * | 11/2010 | Wilson | F01D 5/026 415/216.1 |
| 2010/0310358 | A1 | 12/2010 | Major et al. | |
| 2011/0138769 | A1 | 6/2011 | Costa et al. | |
| 2012/0051923 | A1 | 3/2012 | McDonald et al. | |
| 2012/0183403 | A1 * | 7/2012 | Elmose | F03D 1/0658 416/204 R |

OTHER PUBLICATIONS

Anonymous: "Shear Pin", Wikipedia—The Free Encyclopedia, Sep. 20, 2012, pp. 1-2.
International Preliminary Report on Patentability for International Application No. PCT/US2013/030318 dated Apr. 30, 2015.
International Search Report and Written Opinion for International Application No. PCT/US2013/030318 dated Jun. 26, 2013.

* cited by examiner

STRUCTURAL GUIDE VANE CIRCUMFERENTIAL LOAD BEARING SHEAR PIN

CROSS REFERENCE TO RELATED APPLICATION

This application claims priority to U.S. Provisional Application No. 61/714,814 filed on Oct. 17, 2012.

BACKGROUND

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

The high pressure turbine drives the high pressure compressor through an outer shaft to form a high spool, and the low pressure turbine drives the low pressure compressor through an inner shaft to form a low spool. The fan section may also be driven by the low inner shaft. A speed reduction device such as an epicyclical gear assembly may be utilized to drive the fan section such that the fan section may rotate at a speed different than the turbine section so as to increase the overall propulsive efficiency of the engine. In such engine architectures, a shaft driven by one of the turbine sections provides an input to the epicyclical gear assembly that drives the fan section at a reduced speed such that both the turbine section and the fan section can rotate at closer to optimal speeds.

Although geared architectures have improved propulsive efficiency, turbine engine manufacturers continue to seek further improvements to engine performance including improvements to thermal, transfer and propulsive efficiencies.

SUMMARY

A turbofan engine according to an exemplary embodiment of this disclosure, among other possible things includes a fan case circumscribing a plurality of fan blades disposed about an axis, a core engine case including a bulkhead disposed about the axis, at least one structural guide vane attached on an outer end to the fan case and at an inner end to the bulkhead, and a shear pin extending between the inner end of the structural guide vane and the bulkhead.

In a further embodiment of the foregoing turbofan engine, the inner end of the structural guide vane includes a forward portion attached to a forward case and an aft portion attached to the bulkhead.

In a further embodiment of any of the foregoing turbofan engines, a plurality of forward fasteners extend transverse to the axis through corresponding openings in the forward portion of the inner side into the forward case and a plurality of aft fasteners extend through a corresponding plurality of openings in the bulkhead substantially parallel to the axis for securing the inner end to the bulkhead.

In a further embodiment of any of the foregoing turbofan engines, the inner end of the structural guide vane includes openings corresponding with the plurality of openings in the bulkhead and the shear pin is disposed between the openings in the inner end of the structural guide vane.

In a further embodiment of any of the foregoing turbofan engines, the bulkhead includes blind holes that receive a corresponding shear pin.

In a further embodiment of any of the foregoing turbofan engines, an interface between the aft portion of the structural guide vane and the bulkhead includes mating aligning surfaces.

In a further embodiment of any of the foregoing turbofan engines, the aligning surfaces includes diverging aft surface of the inner end and mating converging surfaces on the bulkhead.

In a further embodiment of any of the foregoing turbofan engines, the converging surfaces on the bulkhead are annular about the axis.

In a further embodiment of any of the foregoing turbofan engines, includes a cover ring disposed on the bulkhead including a plurality of openings corresponding to the openings for the aft fasteners. The cover ring covers openings for the plurality of shear pins.

In a further embodiment of any of the foregoing turbofan engines, the shear pin includes a plurality of shear pins with and a corresponding plurality of structural guide vanes.

A front center body assembly for a turbofan engine according to an exemplary embodiment of this disclosure, among other possible things includes a core engine case structure including a forward case and a bulkhead disposed about an axis. A structural guide vane includes an outer end and an inner end. The inner end includes a forward portion attached to the forward case and an aft portion attached at the bulkhead. A shear pin extends from the aft portion of the structural guide vane into the bulkhead.

In a further embodiment of the foregoing front center body assembly, a plurality of forward fasteners extend transverse to the axis through corresponding openings in the forward portion into the forward case and a plurality of aft fasteners extend through a corresponding plurality of openings in the bulkhead substantially parallel to the axis for securing the aft portion to the bulkhead.

In a further embodiment of any of the foregoing front center body assembly, the shear pin is mounted within the aft portion of the structural guide vane and extends into the bulkhead between openings for the aft fasteners.

In a further embodiment of any of the foregoing front center body assemblies, the bulkhead includes a blind hole receiving a corresponding shear pin.

In a further embodiment of any of the foregoing front center body assemblies, includes a cover ring disposed on the bulkhead including a plurality of openings corresponding to the openings for the aft fasteners. The cover ring covers openings for the shear pin.

In a further embodiment of any of the foregoing front center body assemblies, the shear pin includes a plurality of shear pins and the structural guide vane comprises a corresponding plurality of structural guide vanes.

In a further embodiment of any of the foregoing front center body assemblies, an interface between the aft portion of the structural guide vane and the bulkhead includes mating aligning surfaces for radially orientating the structural guide vane relative to the bulkhead.

A method of assembling a front portion of a turbofan engine according to an exemplary embodiment of this disclosure, among other possible things includes orientating an inner end of structural guide vane relative to a bulkhead of an engine static structure, assembling a shear pin into an aft surface of the inner end that abuts the bulkhead, abutting the aft surface of the inner end against the bulkhead such that the shear pin is received within an opening defined within the bulkhead, securing the inner end of the structural guide vane to the bulkhead with a plurality of aft fasteners extending through the bulkhead and received within the inner end of the structural guide vane such that the shear pin carries circumferential loads.

In a further embodiment of the foregoing method, includes extending a plurality of forward fasteners through a forward portion of the inner end into a forward case.

In a further embodiment of any of the foregoing methods, an interface between the aft surface and the bulkhead includes mating alignment surfaces and the method includes aligning the inner end of the structural guide vane with the alignment surfaces.

Although the different examples have the specific components shown in the illustrations, embodiments of this disclosure are not limited to those particular combinations. The components or features from one of the examples may be used in combination with features or components from another one of the examples.

These and other features disclosed herein can be best understood from the following specification and drawings, the following of which is a brief description.

DETAILED DESCRIPTION

Figure 1:
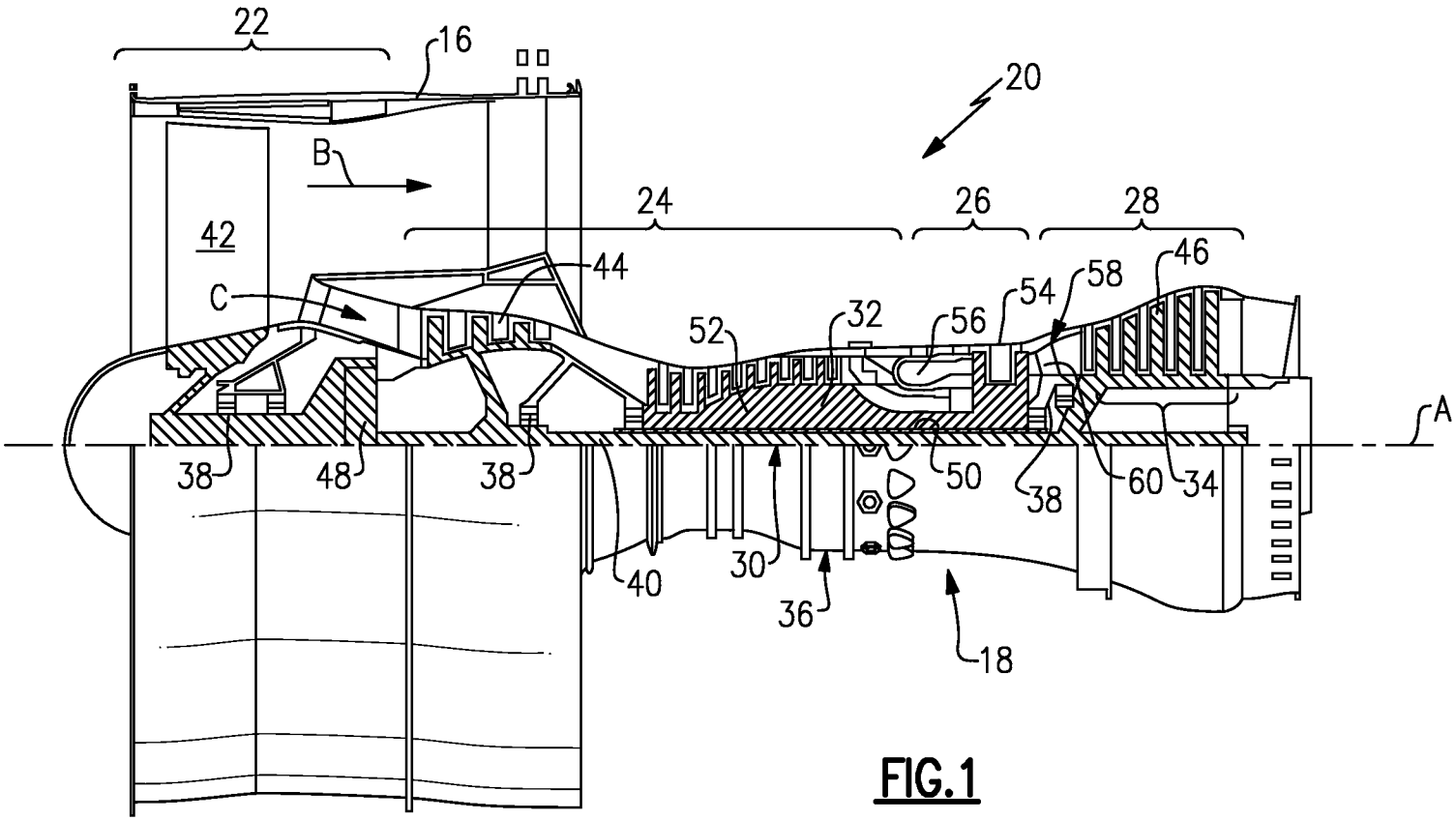
FIG. 1 is a schematic view of an example gas turbine engine.

FIG. 1 schematically illustrates an example gas turbine engine 20 that includes a fan section 22 and a core engine section 18 including a compressor section 24, a combustor section 26 and a turbine section 28. Alternative engines might include an augmenter section (not shown) among other systems or features. The fan section 22 drives air along a bypass flow path B while the compressor section 24 draws air in along a core flow path C where air is compressed and communicated to a combustor section 26. In the combustor section 26, air is mixed with fuel and ignited to generate a high pressure exhaust gas stream that expands through the turbine section 28 where energy is extracted and utilized to drive the fan section 22 and the compressor section 24.

Although the disclosed non-limiting embodiment depicts a turbofan gas turbine engine, it should be understood that the concepts described herein are not limited to use with turbofans as the teachings may be applied to other types of turbine engines including those not including a geared architecture.

The example engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that connects a fan 42 and a low pressure (or first) compressor section 44 to a low pressure (or first) turbine section 46. The inner shaft 40 drives the fan 42 through a speed change device, such as a geared architecture 48, to drive the fan 42 at a lower speed than the low speed spool 30. The high-speed spool 32 includes an outer shaft 50 that interconnects a high pressure (or second) compressor section 52 and a high pressure (or second) turbine section 54. The inner shaft 40 and the outer shaft 50 are concentric and rotate via the bearing systems 38 about the engine central longitudinal axis A.

A combustor 56 is arranged between the high pressure compressor 52 and the high pressure turbine 54. In one example, the high pressure turbine 54 includes at least two stages to provide a double stage high pressure turbine 54. In another example, the high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about 5. The pressure ratio of the example low pressure turbine 46 is measured prior to an inlet of the low pressure turbine 46 as related to the pressure measured at the outlet of the low pressure turbine 46 prior to an exhaust nozzle.

A mid-turbine frame 58 of the engine static structure 36 is arranged generally between the high pressure turbine 54 and the low pressure turbine 46. The mid-turbine frame 58 further supports bearing systems 38 in the turbine section 28 as well as setting airflow entering the low pressure turbine 46.

Airflow through the core flow path C is compressed by the low pressure compressor 44 then by the high pressure compressor 52 mixed with fuel and ignited in the combustor 56 to produce high speed exhaust gases that are then expanded through the high pressure turbine 54 and low pressure turbine 46. The mid-turbine frame 58 includes vanes 60, which are in the core airflow path and function as an inlet guide vane for the low pressure turbine 46. Utilizing the vane 60 of the mid-turbine frame 58 as the inlet guide vane for low pressure turbine 46 decreases the length of the low pressure turbine 46 without increasing the axial length of the mid-turbine frame 58. Reducing or eliminating the number of vanes in the low pressure turbine 46 shortens the axial length of the turbine section 28. Thus, the compactness of the gas turbine engine 20 is increased and a higher power density may be achieved.

The disclosed gas turbine engine 20 in one example is a high-bypass geared aircraft engine. In a further example, the gas turbine engine 20 includes a bypass ratio greater than about six (6), with an example embodiment being greater than about ten (10). The example geared architecture 48 is an epicyclical gear train, such as a planetary gear system, star gear system or other known gear system, with a gear reduction ratio of greater than about 2.3.

In one disclosed embodiment, the gas turbine engine 20 includes a bypass ratio greater than about ten (10:1) and the fan diameter is significantly larger than an outer diameter of the low pressure compressor 44. It should be understood, however, that the above parameters are only exemplary of one embodiment of a gas turbine engine including a geared architecture and that the present disclosure is applicable to other gas turbine engines.

A significant amount of thrust is provided by the bypass flow B due to the high bypass ratio. The fan section 22 of the engine 20 is designed for a particular flight condition— typically cruise at about 0.8 Mach and about 35,000 feet. The flight condition of 0.8 Mach and 35,000 ft., with the engine at its best fuel consumption—also known as "bucket cruise Thrust Specific Fuel Consumption ("TSFC")"—is the industry standard parameter of pound-mass (lbm) of fuel per hour being burned divided by pound-force (lbf) of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.50. In another non-limiting embodiment the low fan pressure ratio is less than about 1.45.

"Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed", as disclosed herein according to one non-limiting embodiment, is less than about 1150 ft/second.

The example gas turbine engine includes fan blades 42 that comprises in one non-limiting embodiment less than about 26 fan blades. In another non-limiting embodiment, the fan section 22 includes less than about 20 fan blades. Moreover, in one disclosed embodiment the low pressure turbine 46 includes no more than about 6 turbine rotors schematically indicated at 34. In another non-limiting example embodiment the low pressure turbine 46 includes about 3 turbine rotors. A ratio between the number of fan blades 42 and the number of low pressure turbine rotors is between about 3.3 and about 8.6. The example low pressure turbine 46 provides the driving power to rotate the fan section 22 and therefore the relationship between the number of turbine rotors 34 in the low pressure turbine 46 and the number of blades 42 in the fan section 22 disclose an example gas turbine engine 20 with increased power transfer efficiency.

Figure 2:
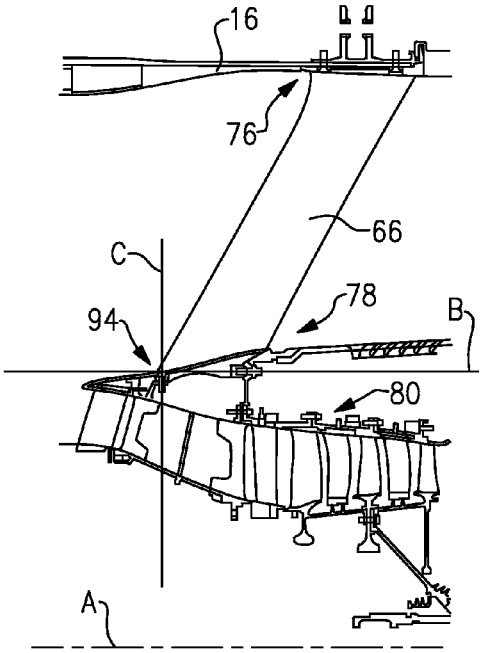
FIG. 2 is a cross-sectional of a front portion of an example gas turbine engine.
Figure 3:
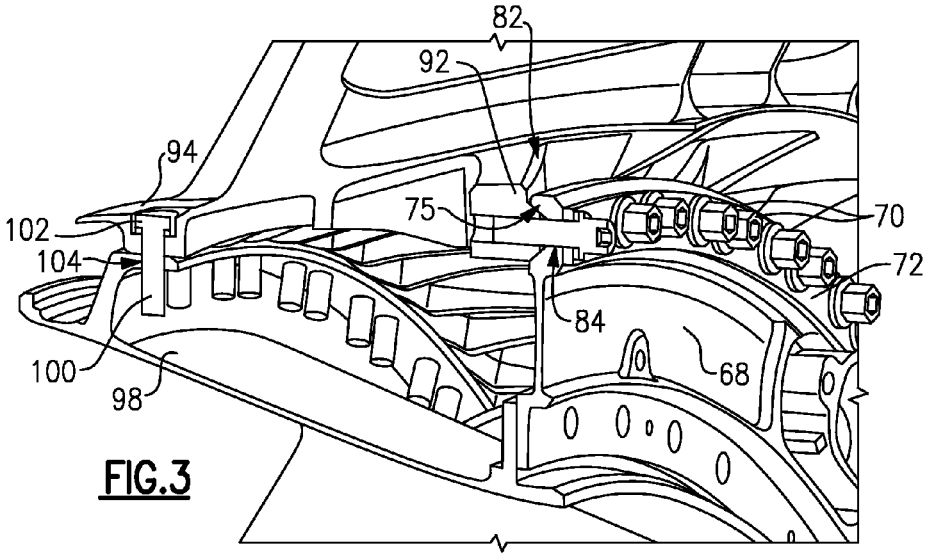
FIG. 3 is a sectional view of a connection between a structural guide vane and an engine case structure.

Referring to FIGS. 2 and 3 with continued reference to FIG. 1, the example engine 20 includes structural guide vanes 66 that provide structural support for the core engine section 18. A front center body 92 includes a bulkhead 68 of the core engine case structure 36 that is attached to a plurality of structural guide vanes 66. Each of the structural guide vanes 66 includes an outer end 76 and an inner end 78. The outer end 76 is attached to a fan case 16 and the inner end 78 is attached to the bulkhead 68. The example structural guide vanes 66 are spaced apart about the axis A. The spacing of the structural guide vanes 66 may be uniform, although non-uniform spacing is within the contemplation of this disclosure.

In this example the bulkhead 68 is part of the low pressure compressor case 80 and is secured to the structural guide vanes 66 at an interface 82. The interface 82 includes mating aligning surfaces 74 and 75. The surfaces 74 are on the inner end 78 of the structural guide vane 66. The surfaces 74 define an aft portion 96 of the inner end 78 and are disposed at an angle relative to a bolt axis B that is substantially parallel to the engine axis A.

Figure 4:
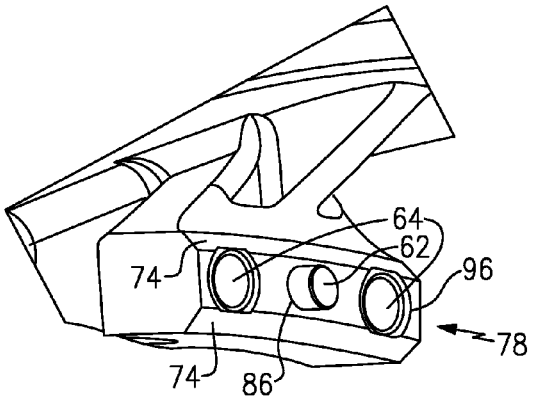
FIG. 4 is a perspective view of a portion of an example structural guide vane.
Figure 5:
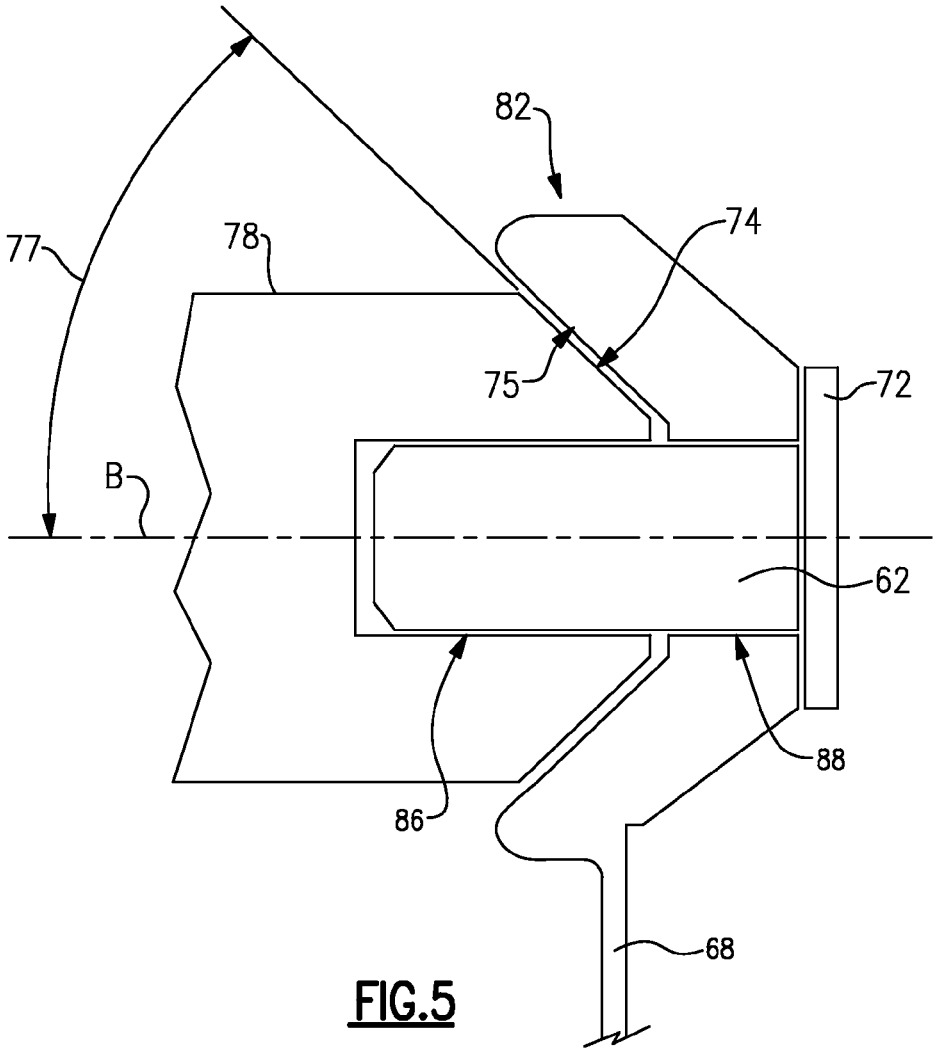
FIG. 5 is a cross-section of an example shear pin extending into an example bulkhead.

Referring to FIG. 5, with continued reference to FIGS. 2, 3, and 4, the surfaces 74 are disposed at an angle 77 relative to the bolt axis B. In this example, the angle 77 is about 40° relative to the bolt axis B. The bulkhead 68 includes corresponding surfaces 75 at a corresponding angle that engages the surfaces 74 to orientate the structural guide vanes 66 relative to the bulkhead 68. The mating angled surfaces 74 and 75 orientate the structural guide vane radially relative to the bulkhead 68. In this example the surfaces 74 define diverging surfaces and the surfaces 75 define mating converging surfaces.

The interface 82 between the bulkhead 68 and the structural guide vanes 66 are under loads along axial, radial and circumferential load paths. The mating surfaces 74 and 75 bear radial and axial loads. The example interface 82 is annular about the axis A and defines mating aligning surfaces that orientate the structural guide vane 66 relative to the bulkhead 68. Accordingly, in this example the surfaces 74 and 75 are annular surfaces that abut each other to provide the desired radial and axial alignment. Aft fasteners 70 extend through openings 84 in the bulkhead 68 and are received within threaded openings 64 defined in the inner end 78 of the structural guide vane 66. In this example the aft fasteners are bolts 70 that provide a clamping force in the axial direction to urge the structural guide vanes 66 and bulkhead 68 together at the interface 82.

A forward portion 94 is secured to a forward case structure 98 by forward fasteners 100. In this example the forward fastener includes a plurality of bolts 100. The bolts 100 extend along an axis C that is transverse to the axis B. The bolts 100 extend through clearance openings 102 within the forward portion 94 and are received within threaded openings 104 defined in the forward case structure 98.

A plurality of shear pins 62 extend from the aft portion 96 of the structural guide vane 66 between corresponding threaded openings 64 at circumferential locations corresponding to each of the structural guide vanes 66. The shear pins 62 bear loads in the circumferential direction such that the bolts 70 are not required to bear circumferential loads.

The bolts 70 provide axial clamping forces between the structural guide vanes 66 while the shear pins 62 bear circumferential loads. The division of loads between the bolts 70 and the shear pins 62 provides a favorable tolerance stack up of the openings 84 for the bolts 70. Because the bolts 70 are not required to bear circumferential loading, the openings 84 through the bulkhead 68 are fabricated with favorable stack up parameters that ease manufacturing and assembly. Because the shear pins 62 bear the circumferential loads, openings for the bolts 70 need not be tightly tolerance to provide contact between the bolts 70 and sidewalls of the openings.

Referring to FIG. 5, with continued reference to FIG. 3, the example shear pin 62 is provided at circumferential locations corresponding to one of the structural guide vanes 66. The structural guide vane 66 includes a blind hole 86 that receives the shear pin 62. The example shear pin 62 is maintained within the blind hole 86 by an interference fit. A corresponding through hole 88 is defined within the bulkhead 68 to receive the pin 62. The through hole 88 within the bulkhead 68 that receives the shear pin 62 may or may not be an interference fit. The through hole 88 receiving the shear pin 62 includes a tolerance that bears circumferential loads that would otherwise be applied to the bolts 70.

Figure 6:
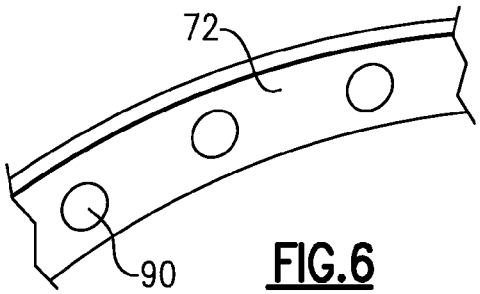
FIG. 6 is a schematic view of an example cover ring.

Referring to FIG. 6, with continued reference to FIGS. 3 and 5, a cover ring 72 is provided on the bulkhead 68 that includes a plurality of openings 90 for the bolts 70, but does not include openings corresponding to the through openings 88 for the shear pins 62. Accordingly, the shear pin 62 is trapped within the interface regardless of the integrity of the interference fit. In another aspect, openings 88 for receiving the pin 62 is a blind hole instead of a through hole shown in FIG. 6, such that the cover ring 72 is not necessary.

Referring to FIGS. 3 and 4, a method of assembling a front center body 92 of a turbofan engine 20 including structural guide vanes 66 includes a first step of orientating an inner end 78 of the structural guide vane 66 relative to a bulkhead 68 of an engine static structure 36. The orientation is provided by aligning mating surfaces 74 on the guide vane 66 with mating surface 75 on the bulkhead 68. A shear pin 62 assembled into the aft surface of the inner end 78 between the mating surfaces 74 is received within an opening 88 defined within the bulkhead 68.

The inner end 78 of the structural guide vane 66 is then secured to the bulkhead 68 with a plurality of aft fasteners 70 extending through the bulkhead 68. Each of the plurality of aft fasteners 70 is received within the inner end 78 of the structural guide vane 66 such that the shear pins 62 carry circumferential loads. That is the aft fasteners 70 extend through openings 64 that provide a clearance fit rather than a close contact fit intended for accommodating circumferential loads. Instead, the shear pin 62 and the opening 88 within the bulkhead 68 that receives the shear pin 62 is toleranced tightly such that the required contact is provided to bear circumferential loading.

The example interface 82 including the shear pin 62 provides an improved connection between the structural guide vane 66 and bulkhead 68 that divides loads and enables favorable stack up tolerances for bolt openings 88 while improving durability and easing assembly.

Although an example embodiment has been disclosed, a worker of ordinary skill in this art would recognize that certain modifications would come within the scope of this disclosure. For that reason, the following claims should be studied to determine the scope and content of this disclosure.

What is claimed is:

1. A turbofan engine comprising:

a fan case circumscribing a plurality of fan blades disposed about an axis;

a core engine including a low pressure compressor case having a bulkhead disposed about the axis and a forward case structure;

at least one structural guide vane attached on an outer end to the fan case and at an inner end to the bulkhead, wherein the inner end of the structural guide vane includes a forward portion attached to the forward case structure and an aft portion attached to the bulkhead and wherein the aft portion of the inner end includes diverging surfaces and the bulkhead includes mating converging surfaces;

a plurality of forward fasteners extend transverse to the axis through corresponding openings in the forward portion of the inner end into the forward case structure;

a plurality of aft fasteners extend through a corresponding plurality of openings in the bulkhead substantially parallel to the axis for securing the inner end to the bulkhead, wherein the diverging surfaces of the inner end and the mating converging surfaces of the bulkhead are disposed at a constant angle relative to a bolt axis for at least one of the plurality of aft fasteners; and a plurality of shear pins disposed circumferentially between at least two of the plurality of aft fasteners and extending between the inner end of the structural guide vane and the bulkhead for bearing a load in a circumferential direction.

2. The turbofan engine as recited in claim 1, wherein the bulkhead includes a plurality of blind holes that receive a corresponding one of the plurality of shear pins.

3. The turbofan engine as recited in claim 2, including a cover ring disposed on the bulkhead including a plurality of openings corresponding to the plurality of openings for the plurality of aft fasteners, wherein the cover ring covers openings for the plurality of shear pins.

4. The turbofan engine as recited in claim 1, wherein the constant angle of the diverging aft surfaces of the inner end and the mating converging surfaces on the bulkhead is 40 degrees.

5. The turbofan engine as recited in claim 4, wherein the mating converging surfaces on the bulkhead are annular about the axis.

6. A front center body assembly for a turbofan engine comprising:

a core engine case structure including a forward case and a low pressure compressor case having a bulkhead disposed about an axis;

a structural guide vane including an outer end and an inner end, the inner end including a forward portion attached to the forward case and an aft portion attached at the bulkhead;

a plurality of forward fasteners extend transverse to the axis through corresponding openings in the forward portion into the forward case and a plurality of aft fasteners extend through a corresponding plurality of openings in the bulkhead substantially parallel to the axis for securing the aft portion to the bulkhead;

an interface radially orientating the aft portion relative to the bulkhead includes converging surfaces on one of the bulkhead and the aft portion and corresponding diverging surfaces on the other of the bulkhead and the aft portion, wherein the converging surfaces and diverging surfaces are disposed at a constant angle relative to a bolt axis for each of the plurality of aft fasteners; and at least one shear pin disposed circumferentially between at least two of the plurality of aft fasteners and extending from the aft portion of the structural guide vane into the bulkhead for bearing a load in a circumferential direction.

7. The front center body assembly as recited in claim 6, wherein the at least one shear pin is mounted within the aft portion of the structural guide vane and extends into the bulkhead between openings for the plurality of aft fasteners.

8. The front center body assembly as recited in claim 7, including a cover ring disposed on the bulkhead including a plurality of openings corresponding to the plurality of openings for the plurality of aft fasteners, wherein the cover ring covers openings for the at least one shear pin.

9. The front center body assembly as recited in claim 6, wherein the bulkhead includes a blind hole receiving one of the at least one shear pin.

10. The front center body assembly as recited in claim 6, wherein the at least one shear pin comprises a plurality of shear pins and the structural guide vane comprises a corresponding plurality of structural guide vanes.

11. A method of assembling a front portion of a turbofan engine comprising:

orientating an inner end of a structural guide vane relative to a bulkhead of an engine static structure;

assembling a plurality of forward fasteners through a forward portion of the inner end into a forward case;

assembling a plurality of aft fasteners through openings in the bulkhead into threaded openings within the inner end of the structural guide vane;

assembling at least one shear pin into an aft surface of the inner end that abuts the bulkhead between at least two of the plurality of aft fasteners;

abutting the aft surface of the inner end against the bulkhead such that the at least one shear pin is received within an opening defined within the bulkhead; and securing the inner end of the structural guide vane to the bulkhead with the plurality of aft fasteners extending through the bulkhead and received within the inner end of the structural guide vane such that the at least one shear pin carries circumferential loads.

12. The method as recited in claim 11, wherein an interface between the aft surface and the bulkhead includes mating alignment surfaces and the method includes aligning the inner end of the structural guide vane with the alignment surfaces.

* * * * *